US005133740A

United States Patent [19]

Kussick

[11] Patent Number: 5,133,740

[45] Date of Patent: Jul. 28, 1992

[54] ORTHOPEDIC PACIFIER

[76] Inventor: Leon Kussick, 1 Surrey La., Livingston, Essex County, N.J. 07039

[21] Appl. No.: 633,298

[22] Filed: Dec. 24, 1990

[51] Int. Cl.[5] ..... A61J 11/00

[52] U.S. Cl. ..... 606/236; 606/234; 606/235; D24/194; D24/195; D24/196; D24/197; 215/11.1; 215/11.2; 215/11.3; 215/11.4; 215/11.5; 215/11.6

[58] Field of Search ..... 606/234–236; 215/11.1–11.6; D24/194–199

[56] References Cited

U.S. PATENT DOCUMENTS

| | | | |
|---|---|---|---|
| 3,130,725 | 4/1964 | Griesinger | 606/236 |
| 3,875,940 | 4/1975 | Beuther | 606/234 |
| 4,765,497 | 8/1988 | Hsu | 215/11.1 |

FOREIGN PATENT DOCUMENTS

| | | | |
|---|---|---|---|
| 0315459 | 9/1956 | Switzerland | 606/236 |
| 8603402 | 6/1986 | World Int. Prop. O. | 606/234 |

*Primary Examiner*—Stephen C. Pellegrino
*Assistant Examiner*—Glenn K. Dawson
*Attorney, Agent, or Firm*—Irwin Ostroff

[57] ABSTRACT

An orthopedic pacifier, which is useful to inhibit or correct a receding lower jaw condition for improved placement of the upper and lower alveolar ridges of an infant's mouth, includes a shield to border the lips, a resiliently deformable bulbous body and a bridge connecting the base end of the body to the shield. The bridge extends between the upper and lower alveolar ridges from the base end to the shield and positions the body with its free end located posteriorly in the mouth. The body has a palatal conforming upper portion, and a lower portion defining an inclined section extending from the base end to the free end to engage the posterior side of the lower alveolar ridge to guide the lower jaw forward to foster its potential to grow into normal position relative to the upper jaw. A depression in the free end guides tongue placement to direct its forces toward the palate to improve control for swallowing.

10 Claims, 1 Drawing Sheet

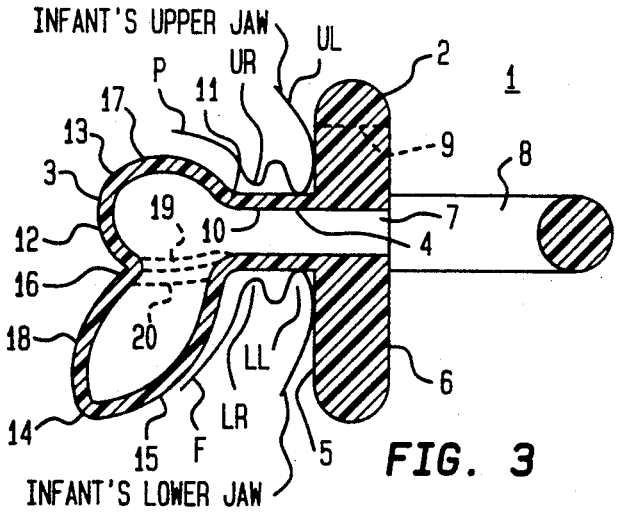
FIG. 3
FIG. 1
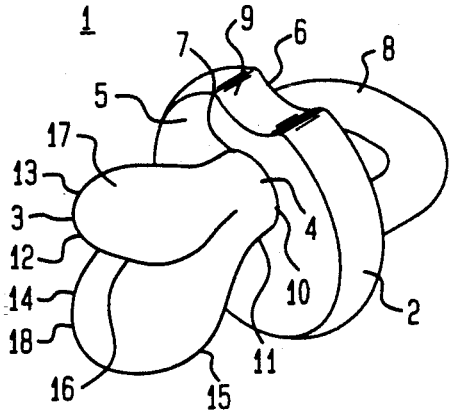
FIG. 2
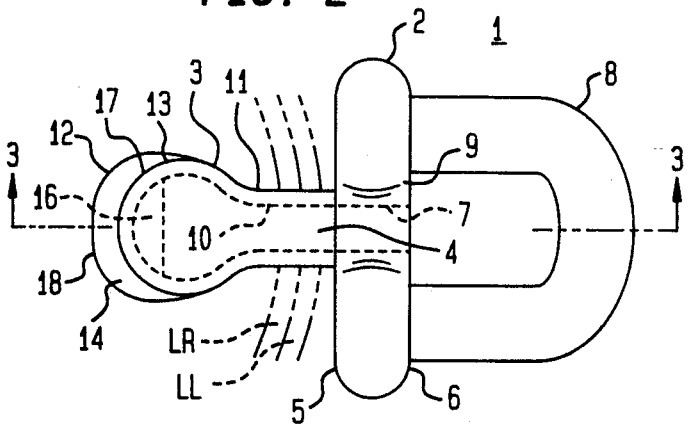
FIG. 6
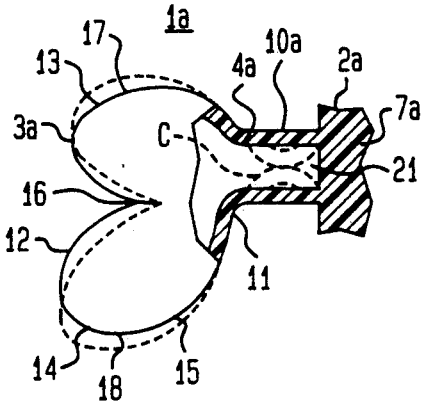
FIG. 7
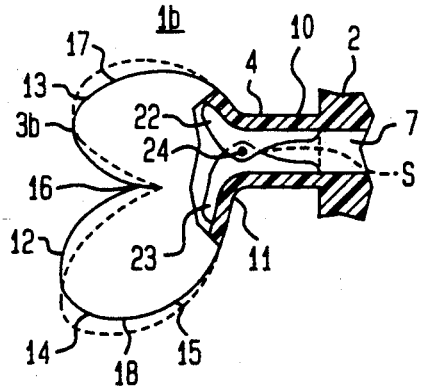
FIG. 4
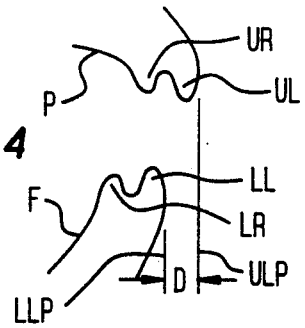
FIG. 5
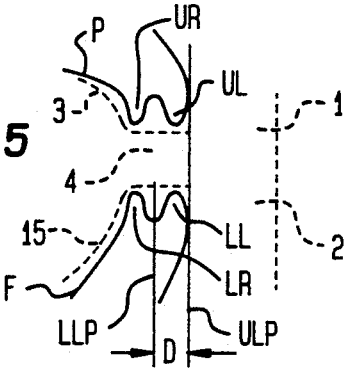
FIG. 8
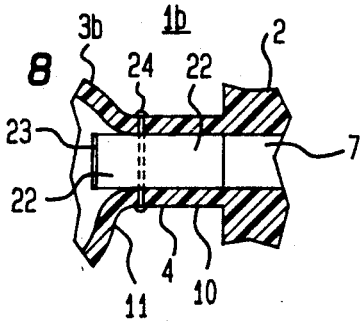

ORTHOPEDIC PACIFIER

FIELD OF THE INVENTION

This invention relates to an orthopedic pacifier with jaw guidance to inhibit or correct a receding lower jaw condition for improved placement of the developing upper and lower alveolar ridges of the mouth of an infant, and with tongue guidance for improved tongue control for swallowing.

BACKGROUND OF THE INVENTION

A pacifier generally comprises a soft rubber or plastic baglet in front of a shield that positions the baglet in the mouth of a baby or young child, and a handle extending from the rear side of the shield to insert and remove the baglet. The baglet may be nipple or bulb shaped, and is sized to fit comfortably in the mouth, where it serves as a thumb sucking deterrent that satisfies the infant's natural sucking needs.

U.S. Pat. Nos. 3,964,489 (Kesselring), 4,078,570 (Frodrich et al.), and 4,381,785 (Robbins) show typical interlockable multi-part pacifiers having the usual flexible baglet.

U.S. Pat. Nos. 2,743,727 and 3,837,932 (both to Griesinger) show pacifiers with a rib or bar on the baglet underside for tongue contact to strengthen and straighten the jaws.

U.S. Pat. No. 2,520,773 (Muller) shows a pacifier with an air filled baglet, vertically divided at its free end to form side by side halves for tongue entry therebetween.

U.S. Pat. No. 3,924,621 (Cassimally) shows a pacifier with a baglet connected to the shield by side legs forming a bridge having a central aperture.

U.S. Pat. No. 4,105,032 (Blomstedt) shows a pacifier with a baglet connected to the shield by side arms having front ends forming a central aperture between the upper and lower front teeth and rear ends located between the upper and lower side teeth in the manner of a bite plate. The side teeth take the biting load, and contact between the front teeth is prevented to enable them to assume the correct biting position.

U.S. Pat. No. 4,773,853 to Leon Kussick (the same inventor as in the present patent application) shows a device mountable on the upper front teeth and having inclined portions to engage the lower front teeth in a specific manner on closing the mouth, to correct oral malocclusions, as by urging a retrusive lower jaw forward and upward while urging the upper jaw backwards when appropriate. This patent reviews pertinent types of oral malocclusion, known orthopedic devices for correcting these abnormalities, and the drawbacks of such devices, including that discussed in the article: "Bone Remodeling, A New Orthodontic Approach for Interceptive and Total Mixed Dentition Therapy", by Leon Kussick, in the ASDC Journal of Dentistry for Children, January-February, 1978.

The orthopedic devices disclosed and discussed in the last mentioned patent are attached to the dentition and are not suitable for young infants, whereas the pacifiers disclosed in the earlier mentioned patents all permit free contact of the tongue with the lower alveolar ridge and are ineffective to foster correction of a receding lower jaw condition.

It is desirable to have an infant's pacifier that avoids tongue contact with the lower alveolar ridge by interposing means to inhibit or correct a receding lower jaw condition for improved placement of the developing upper and lower alveolar ridges, and that improves tongue control for swallowing.

SUMMARY OF THE INVENTION

The present invention solves the foregoing problems by providing an orthopedic pacifier adapted to inhibit or correct a receding lower jaw condition for improved placement of the developing upper and lower alveolar ridges of the mouth of an infant, such as a nursing infant or an infant up to about three years old.

The pacifier of the present invention comprises a shield to border the lips, a baglet formed as a resiliently deformable bulbous body insertable into the mouth and having a base end and a free end opposite the base end, and a bridge connecting the base end to the shield to position the body in the mouth with the free end located posteriorly and the bridge extending between the upper and lower alveolar ridges from the base end to the shield. The resiliently deformable bulbous body has a palatal conforming upper portion to engage the palate, and a lower portion defining lower jaw guiding means arranged for interposing between the tongue and posterior side of the lower alveolar ridge. Such guiding means serve to guide the lower jaw forward to foster the potential of the lower jaw to grow into normal position relative to the upper jaw, and to place the lower alveolar ridge in alignment with the upper alveolar ridge. The free end of the body has a tongue confining depression to guide placement of the tongue to direct its forces toward the palate to improve tongue control for swallowing.

The invention will be better understood from the following more detailed description taken with the accompanying drawings and claims.

BRIEF DESCRIPTION OF THE DRAWINGS

FIG. 1 is a perspective view of a pacifier in accordance with the present invention;

FIG. 2 is a top view of the pacifier of FIG. 1;

FIG. 3 shows a sectional view of the pacifier taken along dashed line 3—3 of FIG. 2;

FIGS. 4 and 5 show schematically the positioning of the upper and lower jaws of an infant with a receding lower jaw condition, with FIG. 4 indicating the receding distance between the lower jaw and upper jaw, and with FIG. 5 indicating the forward guiding of the lower jaw using the pacifier of FIG. 1 of the present invention;

FIG. 6 shows a side view, partially in section, of another pacifier in accordance with the present invention;

FIG. 7 shows a view, similar to that of FIG. 6, of still another pacifier in accordance with the present invention; and FIG. 8 shows a top view, partially in section, of portions of the pacifier shown in FIG. 7, illustrating certain details.

It is to be noted that the drawings are not to scale. Some portions are shown exaggerated to make the drawings easier to understand.

DETAILED DESCRIPTION

Referring now to FIGS. 1,2 and 3, there is shown an orthopedic pacifier 1 in accordance with the present invention. FIG. 1 shows a perspective view; FIG. 2 shows a top view of FIG. 1; and FIG. 3 shows a section view of FIG. 2 taken through a dashed line 3—3 of FIG. 2. In FIG. 3 the pacifier is shown in position in an infant's mouth with the infant's lower and upper jaws engaged against the pacifier 1. Pacifier 1 is adapted to inhibit or correct a receding lower jaw condition for improved placement of the developing upper alveolar ridge UR and lower alveolar ridge LR of the mouth of an infant. Pacifier 1 comprises a vertical plate or shield 2 for externally bordering the upper lip UL and lower lip LL of the infant's jaw, a resiliently deformable bulbous body 3 sized for insertion and comfortable fit in the mouth of an infant, and a horizontal bridge 4 connecting body 3 to the shield 2.

The shield 2 has an inner side 5 that is positioned adjacent lips UL,LL to border the lips and limit insertion of pacifier 1 into the mouth, and an outer side 6 remote from the lips. Shield 2 may contain a central horizontal slot 7 of suitable, e.g., rectangular, cross sectional shape, an external handle or pull ring 8 attached to outer side 6, and a central notch 9 in its upper edge to permit shield 2 to clear the overlying nose of the infant when pacifier 1 is in the mouth.

Bridge 4 may be formed as a hollow extension or neck 10 of body 3, of like, e.g., rectangular, cross sectional shape to that of slot 7. Body 3 may also be hollow, so that its interior communicates via neck 10 and slot 7 with the exterior of pacifier 1 at outer side 6.

Body 3 has an anterior base end 11 that is adjacent shield 2 and connected thereto by neck 10, and a posterior free end 12 opposite base end 11. Body 3 also has a palatal conforming upper portion 13 for engaging the palate P, and a lower portion 14 conforming to the floor F of the mouth. As is clear from FIG. 1, lower portion 14 defines lower jaw guiding means, such as a lower jaw guiding inclined section 15, e.g., forming an inclined anterior wall, that extends posteriorly angularly downwardly from base end 11 toward free end 12, and that follows the contour of the posterior side of lower alveolar ridge LR and floor F of the mouth.

As shown in FIGS. 1 and 3, body 3 may be formed as a bipartite or bifurcated member, and particularly as a bilobate member, having a posterior tongue confining depression 16. In particular, body 3 has an upper part or lobe 17 forming upper portion 13, and a lower part or lobe 18 forming lower portion 14. Upper lobe 17 vertically overlies lower lobe 18, and these two parts extend from base end 11, formed as a unitary or common base end, to free end 12, formed as a horizontally divided or bilobate free end, that defines depression 16 vertically between upper and lower lobes 17,18 to guide tongue placement.

As is clear from FIGS. 2 and 3, bridge 4 mounts base end 11 on shield 2 to position body 3 in the mouth with free end 12 located posteriorly and bridge 4 extending between, i.e., intermediately of and across, upper and lower alveolar ridges UR,LR from base end 11 to shield 2.

Due to the orientation and constructional relationship of the associated components of pacifier 1, lower lobe 18 and its inclined section 15 are arranged for interpositioning between the tongue and posterior side of lower alveolar ridge LR. This prevents normal tongue engagement with lower alveolar ridge LR and serves to guide the lower jaw forward, in that the infant is encouraged to compensate for the interfering disposition of lower lobe 18 and its inclined section 15 between the tongue and lower alveolar ridge LR by urging the lower jaw forward a distance increment to adjust for such interference.

This guiding of the lower jaw forward fosters the potential of the lower jaw to grow into normal position relative to the upper jaw, and to improve placement of the developing upper and lower alveolar ridges UR, LR by correspondingly bringing lower alveolar ridge LR forward into alignment with upper alveolar ridge UR. The presence of lower lobe 18 and its inclined section 15 in guiding interfering disposition between the tongue and posterior side of the lower alveolar ridge LR serves to inhibit a potential or incipient receding lower jaw condition from developing or to correct such a condition if it already exists.

This will minimize occurrence of orthopedic or orthodontic problems traceable to that type of potential or actual condition in an infant such as a nursing infant or one up to an age of about three years.

The posteriorly diverging shape of body 3 advantageously makes it difficult for the infant to expel pacifier 1 from the mouth, as the jaw guiding means, e.g., inclined section 15, extending from the floor F of the mouth upwardly to bridge 4, holds back the tongue, while the vertical expanse of body 3 at diverging bilobate free end 12 inhibits ejection of pacifier 1. On the other hand, body 3 may be easily inserted by an attendant into the infant's mouth by merely squeezing together upper and lower parts or lobes 17,18.

As is clear from FIG. 3, inclined section 15 is sufficiently sharp in incline and sufficiently long to prevent placement of the lower jaw or lower alveolar ridge LR behind i.e., posteriorly of, inclined section 15, and thus inclined section 15 assures positive guidance of the lower jaw forward in desired manner.

At the same time, depression 16 guides placement of the tongue to direct its forces toward palate P to improve tongue control for swallowing, while the guiding of the lower jaw forward by inclined section 15 inhibits such forces from being directed toward lower alveolar ridge LR.

Referring now to FIG. 4, there is shown the mouth of an infant having a receded lower jaw condition. With the jaws slightly open, lower lip LL is located in an imaginary lower lip vertical transverse plane LLP at an incremental horizontal distance D posteriorly of the imaginary upper lip vertical transverse plane ULP, which is parallel thereto and in which upper lip UL is located. This is due to the receded condition of the lower jaw, which causes the latter to be positioned a like distance posteriorly of the upper jaw. Lower alveolar ridge LR and upper alveolar ridge UR are similarly spaced apart by such a distance.

Referring to FIG. 5, when pacifier 1 of the invention (shown partially in phantom) is inserted into the same infant's mouth, the interpositioning of lower portion 14 and its inclined section 15 between the tongue and posterior side of lower alveolar ridge LR encourages the infant to extend the lower jaw forward to compensate for the interfering presence of inclined section 15. This results in a guiding of the lower jaw forward an increment approximating distance D so as to inhibit or correct such a receding lower jaw condition.

As is clear from the sectioned portions of pacifier 1 shown in FIG. 3, shield 2, body 3 and bridge 4 may each be formed of self-supporting, resiliently deformable elastic material, such as suitable soft rubber or plastic, and may be integrally interconnected to form a unitary composite. Pull ring 8 may also be integral with shield 2. The materials of all parts of pacifier 1 will be nontoxic for safe infant use.

While shield 2 is shown with slot 7, and body 3 and bridge 4 are shown as hollow members, it is to be understood that slot 7 may be omitted, and that body 3 and bridge 4 may each be formed as a solid member of such soft, resiliently deformable material, or as a corresponding soft rubber or plastic foam filled resiliently deformable member.

Also, as shown in phantom in FIG. 3, upper lobe 17 may contain an internal wall 19, and lower lobe 18 may contain a like internal wall 20, closing off the individual interiors of upper lobe 17 and lower lobe 18 from each other. This permits engrafting lower lobe 18 as a separate part onto the underside of a preformed upper lobe 17 that is preconnected via neck 10 to shield 2. Alternatively, walls 19 and 20 may comprise a fused or unitary wall serving the same purpose.

Referring now to FIG. 6, there is shown a pacifier 1*a* in accordance with the present invention in which like parts to those of pacifier 1 have the same reference numerals. In this case, slot 7 is replaced by plug portion 7*a* at bridge 4*a* to form a solid shield 2*a* closing off the interiors of hollow neck 10*a* and hollow body 3*a* from communication with the exterior of shield 2*a*, so that these interiors form a closed common chamber 21. Chamber 21 is filled with a pressure fluid 21*a*, such as air or water, to define a common captive pressure fluid inflated chamber, which serves to distend upper and lower lobes 17,18 so that they are kept normally only slightly vertically spaced apart at free end 12 to enable convenient insertion of body 3*a* into the mouth.

However, as the infant bites resiliently deformable hollow neck 10*a*, e.g., of rectangular cross sectional shape, the biting compression of neck 10*a* between upper and lower alveolar ridges UR,LR squeezes the horizontal top and bottom wall portions of neck 10*a* to a constriction position C, against the resilient counterforce of the vertical side wall portions of neck 10*a*. This temporarily causes transfer of pressure fluid from neck 10*a* to upper and lower lobes 17,18 for further locally inflating these parts to spread them vertically further apart at free end 12 during the compression, as shown in phantom in FIG. 6. This spreading action serves to inhibit ejection of pacifier 1*a* by the infant.

Referring now to FIGS. 7 to 8, there is shown another pacifier 1*b* in accordance with the present invention in which like parts to those of pacifier 1 have the same reference numerals. FIG. 7 shows a cross-sectional view of the pacifier 1*b* and FIG. 8 shows a partial top view, partially section, of the pacifier 1*b*. In pacifier 1*b*, body 3*b* is formed with upper and lower lobes 17,18 that are kept normally only slightly vertically spaced apart to enable convenient insertion of body 3*b* into the mouth. A mechanical bilateral lever mechanism is mounted in hollow neck 10, which includes a bilateral upper lever 22 having opposed first and second arms, that overlies a bilateral lower lever 23 also having opposed first and second arms. Levers 22,23 are pivotally interconnected in the manner of a clothes pin by a transverse horizontal pin 24 seated in the vertical side wall portions of neck 10 at base end 11.

Pin 24 serves to position the first arm of upper lever 22 in overlying relation to the first arm of lower lever 23 in neck 10, e.g., of rectangular cross sectional shape, and correspondingly to position the second arm of upper lever 22 in upper lobe 17 in overlying relation to the second arm of lower lever 23 in lower lobe 18. While the first arms are normally horizontal and parallel, the second arms outwardly vertically diverge to follow the natural contour of the adjacent inclined interior wall portions of upper lobe 17 and lower lobe 18, respectively.

Levers 22,23 may be suitably formed of shape retaining, load bearing material, e.g., rigid plastic. The first arm of upper lever 22 may be affixed, e.g., by conventional bonding cement, to the overlying horizontal top wall portion of neck 10, and the first arm of lower lever 23 may be similarly affixed, e.g., by such bonding cement, to the underlying horizontal bottom wall portion of neck 10.

Due to the resiliently deformable nature of neck 10, the vertically opposed first arms of levers 22 and 23 affixed to the top and bottom wall portions of neck 10 are kept resiliently spaced apart by the resiliently deformable vertical side wall portions of neck 10. This arrangement keeps the vertically opposed second arms of levers 22 and 23 in upper lobe 17 and lower lobe 18, respectively, correspondingly spaced apart.

However, as the infant bites hollow neck 10, the biting compression of neck 10 between upper and lower alveolar ridges UR,LR temporarily squeezes the horizontal top and bottom wall portions of neck 10 to a squeeze position S, against the resilient counterforce of the vertical side wall portions of neck 10, which temporarily causes the first arms in neck 10 to move vertically toward each other and the second arms in lobes 17 and 18 to move vertically away from each other to spread lobes 17 and 18 vertically further apart at free end 12 during the compression, as shown in phantom in FIG. 7. This spreading action serves to inhibit ejection of pacifier 1*b* by the infant in similar manner to pacifier 1*a* of FIG. 6.

It will be understood that other means may be used to keep levers 22,23 in desired normally spaced apart relation, such as by interposing a resilient wedge element (not shown) between their first arms that undergoes temporary compression during the squeezing action, and that returns the levers to normal spaced apart relation when the biting compression subsides.

Accordingly, it can be appreciated that the specific embodiments described are merely illustrative of the general principles of the invention. Various modifications may be provided consistent with the principles set forth.

What is claimed is:

1. An orthopedic pacifier adapter to inhibit or correct a receding lower jaw condition for improved placement of the developing upper and lower alveolar ridges of the mouth of an infant, the pacifier comprising:

a shield to border the lips of the infant externally, a bulbous body insertable into the mouth above the floor of the mouth and having a base and a free end opposite the base end, and a bridge connecting the base end to the shield to position the body in the mouth with the free end located posteriorly relative to the mouth and the bridge configured to extend between the upper and lower alveolar ridges from the base end to the shield; and the body having a palatal conforming upper portion to engage the palate, and a lower portion defining a lower jaw guiding inclined section extending angularly downwardly from the base end toward the free end so as to follow the contour of the lower alveolar ridge and the adjacent floor of the mouth of the infant, the inclined section being arranged for interposing between the tongue and posterior side of the lower alveolar ridge to hold back the tongue and to engage the posterior side of the lower alveolar ridge to guide the lower jaw forward to foster the potential of the lower jaw to grow into normal position relative to the upper jaw, the inclined section being sufficiently sharp in incline and sufficiently long to prevent placement of the lower alveolar ridge posteriorly of the inclined section.

2. The pacifier of claim 1 wherein the body is bipartite having an upper part forming the upper portion and a lower part forming the lower portion, the upper part vertically overlying the lower part in the bipartite body and the upper and lower parts extending from the base end which is unitary to the free end defining a tongue confining depression between the upper and lower parts to guide placement of the tongue to direct tongue forces toward the palate to improve tongue control for swallowing.

3. The pacifier of claim 2 wherein the body is bilobate, having an upper lobe forming the upper part and a lower lobe forming the lower part.

4. The pacifier of claim 2 wherein the body and bridge are formed of self-supporting elastic material.

5. The pacifier of claim 4 wherein the body and bridge are hollow and form a common captive pressure fluid inflated chamber containing a pressure fluid such that biting compression of the bridge between the upper and lower alveolar ridges temporarily causes transfer of the pressure fluid from the bridge to the upper and lower parts for further inflating the parts to be spread vertically apart at the free end during the compression.

6. An orthopedic pacifier adapted to inhibit or correct a receding lower jaw condition for improved placement of the developing upper and lower alveolar ridges of the mouth of an infant, the pacifier comprising:

a shield to border the lips of the infant externally, a bulbous body insertable into the mouth and having a base end and a free end opposite the base end, and a bridge connecting the base end to the shield to position the body in the mouth with the free end located posteriorly relative to the mouth and the bridge configured to extend between the upper and lower alveolar ridges from the base end to the shield; and the body having a palatal conforming upper portion to engage the palate, and a lower portion defining lower jaw guiding means arranged for interposing between the tongue and posterior side of the lower alveolar ridge to guide the lower jaw forward to foster the potential of the lower jaw to grow into normal position relative to the upper jaw;

wherein the body is bipartite having an upper part forming the upper portion and a lower part forming the lower portion, the upper part vertically overlying the lower part in the bipartite body and the upper and lower parts extending from the base end which is unitary to the free end which is divided defining a tongue confining depression between the upper and lower parts to guide placement of the tongue to direct tongue forces toward the palate to improve tongue control for swallowing;

wherein the body and bridge are formed of self-supporting elastic material; and wherein a mechanical bilateral lever mechanism is mounted in the bridge and includes first vertically opposed arms resiliently spaced apart in the bridge and second vertically opposed arms resiliently spaced apart in the upper part and lower part, respectively, such that biting compression of the bridge between the upper and lower alveolar ridges temporarily causes the first arms to move vertically toward each other and the second arms to move vertically away from each other to spread the parts vertically apart at the free end during the compression.

7. An orthopedic pacifier adapted to inhibit or correct a receding lower jaw condition for improved placement of the developing upper and lower alveolar ridges of the mouth of an infant, the pacifier comprising:

a shield to border the lips of the infant externally;

a bulbous body formed of self-supporting elastic material and insertable into the mouth above the floor of the mouth and having a base end and a free end opposite the base end, and a bridge formed of self-supporting elastic material and connecting the base end to the shield to position the body in the mouth with the free end located posteriorly relative to the mouth and the bridge configured to extend between the upper and lower alveolar ridges from the base end to the shield;

the body being bipartite, having a palatal conforming upper part to engage the palate, and a lower part defining a lower jaw guiding inclined section extending angularly downwardly from the base end toward the free end so as to follow the contour of the lower alveolar ridge and the adjacent floor of the mouth of the infant, the inclined section being arranged for interposing between the tongue and posterior side of the lower alveolar ridge to hold back the tongue and to engage the posterior side of the lower alveolar ridge to guide the lower jaw forward to foster the potential of the lower jaw to grow into normal position relative to the upper jaw, the inclined section being sufficiently sharp in incline and sufficiently long to prevent placement of the lower alveolar ridge posteriorly of the inclined section; and the upper part vertically overlying the lower part in the bipartite body and the upper and lower parts extending from the base end which is unitary to the free end which is defining a tongue confining depression between the upper and lower parts to guide placement of the tongue to direct tongue forces toward the palate to improve tongue control for swallowing.

8. The pacifier of claim 7 wherein the body is bilobate, having an upper lobe forming the upper part and a lower lobe forming the lower part.

9. The pacifier of claim 8 wherein the body and bridge are hollow and form a common captive pressure fluid inflated chamber containing a pressure fluid, such that biting compression of the bridge between the upper and lower alveolar ridges temporarily causes transfer of the pressure fluid from the bridge to the upper and lower lobes for further inflating the lobes to be spread vertically apart at the free end during the compression.

10. An orthopedic pacifier adapted to inhibit or correct a receding lower jaw condition for improved placement of the developing upper and lower alveolar ridges of the mouth of an infant, the pacifier comprising:

a shield to border the lips of the infant externally a bulbous body insertable into the mouth and having a base end and a free end opposite the base end, and a bridge connecting the base end to the shield to position the body in the mouth with the free end located posteriorly relative to the mouth and the bridge configured to extend between the upper and lower alveolar ridges from the base end to the shield;

the body being bipartite, having a palatal conforming upper part to engage the palate, and a lower part defining a lower jaw guiding inclined section extending angularly downwardly from the base end toward the free end and arranged for interposing between the tongue and posterior side of the lower alveolar ridge to engage the posterior side of the lower alveolar ridge to guide the lower jaw forward to foster the potential of the lower jaw to grow into normal position relative to the upper jaw; and the upper part vertically overlying the lower part in the bipartite body and the upper and lower parts extending from the base end which is unitary to the free end which is divided defining a tongue confining depression between the upper and lower parts to guide placement of the tongue to direct tongue forces toward the palate to improve tongue control for swallowing;

wherein the body is bilobate, having an upper lobe forming the upper part and a lower lobe forming the lower part, and the body and bridge are formed of self-supporting elastic material; and wherein a mechanical bilateral lever mechanism is mounted in the bridge and includes first vertically opposed arms resiliently spaced apart in the bridge and second vertically opposed arms resiliently, such that biting compression of the bridge between the upper and lower alveolar ridges temporarily causes the first arms to move vertically toward each other and the second arms to move vertically away from each other to spread the lobes vertically apart at the free end during the compression.

* * * * *